US007327252B2

(12) United States Patent
Goehler

(10) Patent No.: US 7,327,252 B2
(45) Date of Patent: Feb. 5, 2008

(54) EMERGENCY RESCUER TRACKING SYSTEM AND METHOD

(75) Inventor: Rolf Goehler, Schaumburg, IL (US)

(73) Assignee: GE Security, Inc., Bradenton, FL (US)

( * ) Notice: Subject to any disclaimer, the term of this patent is extended or adjusted under 35 U.S.C. 154(b) by 195 days.

(21) Appl. No.: 11/140,924

(22) Filed: Jun. 1, 2005

(65) Prior Publication Data

US 2006/0273894 A1 Dec. 7, 2006

(51) Int. Cl.
*G08B 1/08* (2006.01)

(52) U.S. Cl. ..... 340/539.13; 340/539.11; 340/572.1

(58) Field of Classification Search ..... 340/572.1, 340/572.4, 573.1, 573.3, 573.4, 573.5, 573.7, 340/539.11, 539.13, 539.14, 539.16, 539.17, 340/511, 10.2
See application file for complete search history.

(56) References Cited

U.S. PATENT DOCUMENTS 6,300,903 B1 * 10/2001 Richards et al. ..... 342/450
6,512,478 B1 * 1/2003 Chien ..... 342/357.09
6,774,782 B2 * 8/2004 Runyon et al. ..... 340/505
6,853,303 B2 * 2/2005 Chen et al. ..... 340/573.1
6,917,288 B2 * 7/2005 Kimmel et al. ..... 340/511
7,103,344 B2 * 9/2006 Menard ..... 455/343.2
7,132,932 B2 * 11/2006 Namm et al. ..... 340/435

* cited by examiner

*Primary Examiner*—Van T. Trieu
(74) *Attorney, Agent, or Firm*—Baker & Hostetler LLP

(57) ABSTRACT

By incorporating automatic location and identity sensor equipment in an emergency or rescue scenario to facilitate a centralized tracking operation, fire fighters, rescuers, urban combat, etc. operations can be coordinated with greater safety by enabling the tracking of individuals. Passive and active RFID devices incorporated into helmets, badges, or PDA's and cell phones can be used in conjunction with transceivers disposed about the rescue environment to generate real-time tracking and alarm status alerts for the rescuers. External database information, such as the layout of the building, as well as pre-existing communication and security controls in the building can be incorporated into the tracking system to provide increased synergy and effectiveness in rescue or tracking operations. The system is sufficiently modular to enable rapid and scalable deployment to rescue locations.

21 Claims, 3 Drawing Sheets

EMERGENCY RESCUER TRACKING SYSTEM AND METHOD

FIELD OF THE INVENTION

The present invention relates generally to the wireless tracking of personnel. More particularly, the present invention relates to wirelessly tracking the location and identity of emergency rescuers in a rescue environment.

BACKGROUND OF THE INVENTION

Conventional approaches to tracking rescuers are based on wireless communications from walkie talkies or radio handsets carried by the rescue personnel. Specifically, the locations of the rescue personnel are solely determined by voice responses or visual sightings from the various members of the rescue team. In order for the rescue team members to accurately relay to the team coordinator their locations, the team member must have an a priori understanding of the layout of the rescue environment. For example, in a fire rescue scenario, the rescue team members assess the number of floors, access points, hallways, stairwells, and other structurally related configurations in the building under fire before entering the building.

It is not uncommon for rescuers to become disorientated, either from a lack of familiarity with the building layout or smoke, so as to result in the rescuer's incorrect assessment of their location. Further, in hazardous rescue situations, it is also not uncommon for the rescuer himself to be rendered incapable of providing his location either through equipment failure or the rescuer becoming unconscious.

Therefore, it is desirable to provide systems and methods which enable the tracking of rescuers within a rescue environment, without requiring voice responses or the rescuer's familiarity of the rescue environment layout.

SUMMARY OF THE INVENTION

The foregoing needs are met, to a great extent, by the present invention, wherein in one aspect an apparatus is provided that in some embodiments, systems and method for tracking rescuers in a rescue environment using portable RFID tracking systems.

In accordance with one embodiment of the present invention, an emergency personnel tracking system is provided, comprising a personal, mobile short range, passive RFID device, a personal, mobile long range, active RFID device, a fixed location transceiver, capable of initiating a communication from the passive RFID device, located within a rescue environment, and a signal fusion console receiving communications from the transceiver, wherein the passive and active RFID devices are in communication with the transceiver to provide an information of the passive and active RFID devices, and the transceiver is in communication with the signal fusion console, wherein the signal fusion console relays a location information of the passive and active RFID devices for tracking of emergency personnel about the rescue environment.

In another embodiment of the invention, a method for tracking emergency personnel in a rescue environment is provided, comprising the steps of configuring personal, mobile passive RFID devices for emergency rescue operation, configuring personal, mobile active RFID devices for emergency rescue operation, configuring transceivers for communication with the passive and active RFID devices, distributing at least one of the configured transceivers within the rescue environment, and tracking the passive and active RFID devices within the rescue environment via communications received from the at least one of the configured transceivers to a signal fusion console.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
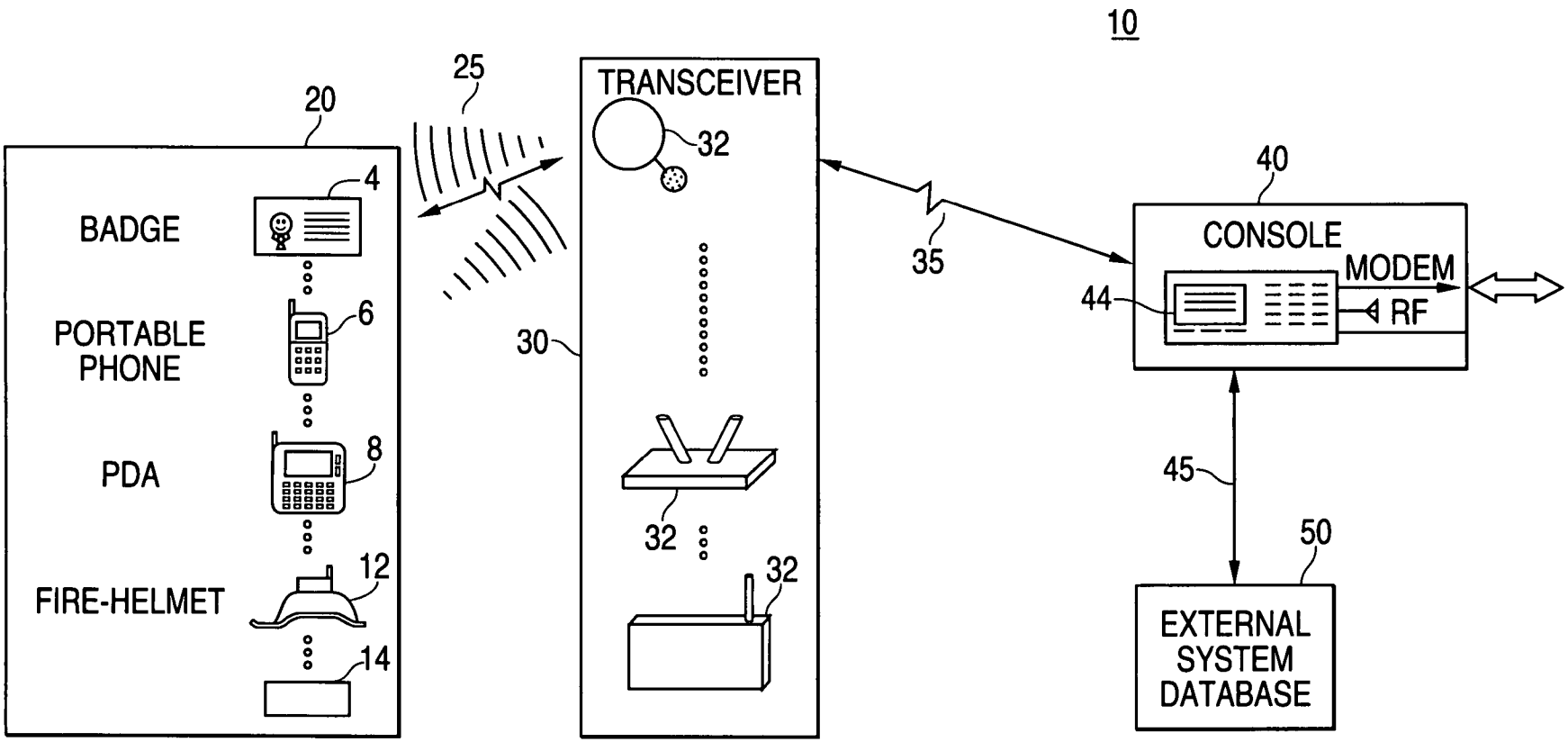
FIG. 1 is a block diagram of an exemplary embodiment of the invention.

The invention will now be described with reference to the drawing figures, in which like reference numerals refer to like parts throughout. An embodiment in accordance with the present invention provides systems and methods for incorporating automatic location and identity sensor equipment in an emergency or rescue scenario to facilitate a centralized tracking operation. The exemplary embodiments described herein, accordingly, are well suited for fire fighters, rescuers, urban combat, where the tracking of numerous individuals in a building or urban environment is deemed advantageous.

FIG. 1 is a block diagram of an exemplary embodiment 10 according to this invention. The exemplary embodiment 10 contains an assortment of portable wireless communication devices 20 using wireless communication 25 to transceiver unit 30 disposed about known locations in a target environment. The transceiver(s) 30 use communication channels 35 to communicate to a signal fusion processor 40. In turn, the signal fusion console 40 can optionally communicate to an external system/database 50 via communication channel 45.

The exemplary suite of portable wireless devices 20, carriable by emergency personnel, may be any one or more of a badge 4, cellular telephone 6, personnel digital assistant (PDA) 8, protective gear/helmet 12 or other arbitrary mobile system 14. Each of the portable or cellular devices provides variant degrees of communication capabilities which may be outfitted with location providing sensors. For example, the portable telephone 6 may contain a global positioning system (GPS) as well as the PDA 8. As such, a GPS-enabled device can provide inherent, near-real time location information, given known in-building limitations, to the carrying individual. In addition to having a GPS-enabled capability, the portable telephone 6 or PDA 8 may be equipped with a radio frequency ID (RFID) component to interface with transceiver(s) 30. As the portable telephone 6 or PDA 8 may be modified to have a desired RFID capability for location tracking, simpler systems such as the badge 4 and helmet 12 and arbitrary device 14 are enabled with RFID capabilities incorporated therein. These latter devices can be cost effectively distributed to rescuers and therefore enable comprehensive tracking of rescuers in a rescue environment. Additionally, these devices can be outfitted to residents or workers, if needed, and may be compatible with their cell phones or access badges. For best coverage, in a preferred embodiment, each of the RFID-enabled devices contains a passive RFID and an active RFID system, as will be further discussed below. Alternatively, the telephone 6 or PDA 8 may be used solely for communication or information purposes, with the badge 4, helmet 12, or other system 14 providing the location function. Thus, various mixing or capabilities can be performed without departing from the spirit and scope of the invention.

Passive RFID tags or systems are understood in the art to require little to no power and are typically responsive to a triggering signal initiated from a master device such as the transceiver 30. Passive RFID tags or systems are typically limited in their effective range and are conventionally relegated to "local" detection schemes, referred to in the art as "near field." As mentioned above, portable communication each device 20 is also equipped with an active RFID tag or system. Active RFID systems are understood in the art to have higher power and range capabilities than that of a passive RFID system. Additionally, active RFID systems are not typically triggered or put into operational mode from a master transceiver 30, but are often self-powered. Thus, the active RFID systems in the various devices operate in a super-local domain, referred to in the art as "far field." In summary, passive RFID systems can be considered as analogous to a transponder, only responding when an interrogation signal is initiated by a transceiver 30 or other interrogating device. In contrast, the active RFID systems can be considered to operate akin to that of a beacon by periodically or aperiodically sending out signals for reception by a transceiver 30. Therefore, each of the mobile devices 20 can operate in at least one or more of the passive and active RFID modes to enable communication to a receiving station such as the transceiver 30.

Current state-of-the-art passive RFID coverage is understood to encompass a range of approximately 5-15 feet or more for conventional passive RFID systems. Current state-of-the-art active RFID is understood to have a greater coverage area of approximately 15-100 feet or more. Of course, these ranges may change according to the power levels used and advancements in RFID technology and therefore these ranges are not considered to be limiting to the embodiments described herein. Since far field RFID units or systems may have a self-powered capability, they may be accommodated with additional features such as increased memory, computational capabilities, communications controls, emergency alerts, etc. Due to the increased power or range of far field RFID units, less transceivers are needed for a given dimensional area than for a corresponding near field RFID unit.

Having a dual mode of (e.g., passive-active) capability enables detection by multiple transceivers 30 to be more easily resolved by correlating relative distances between active RFID detection locations and passive RFID detection locations. For example, an active RFID signal may be received by multiple transceivers 30, resulting in a possible location ambiguity. Resolution of the mobile device 20 location can be found by a single process of elimination between the passive and active RFID signals, wherein the single transceiver 30 having the only passive RFID signal detection would indicate the location of the mobile device 20. Additionally, triangulation schemes or mean-distance, or other now known or future derived location determining schemes may be used to determine the location of the mobile device 20. Since RFID, in the context of passive or active capabilities, is rapidly becoming commercially available, and the particularities of such are well known, they are not further detailed herein.

It should be appreciated that the transceivers 30 may be of any form having any one or more of single, directional, multiple, etc. antennas or electromagnetic signal receiving element or device to enable the reception of passive/active RFID signals, as desired. Accordingly, based on the dimensions or physical attributes encountered within a rescuing environment, varying types of transceivers 30 may be used to enhance the coverage or location capabilities, as needed. For example, in a large room such as an auditorium, a single transceiver 30 may not be capable of providing complete coverage. Therefore, transceivers 30 having directional, beam enhancing capabilities may be used to enable segmentation or parsing of the coverage area between neighboring transceivers 30.

The signals received by the transceivers 30 are conveyed to a signal fusion console 40 via communication channel 35. The communication channel 35 may be any one or more wireless, wired, broadcast, peer to peer, point-to-multi point, multi-point-to-point system, etc., as deemed appropriate. In various exemplary embodiments of the invention, the transceivers 30 are coupled to "resident" network in the rescue environment, when appropriate. Thus, the transceivers 30 may communicate to the signal fusion console 40 using a wired IP or a LAN system that is pre-wired or configured in the building. Alternative networks such as a wireless IEEE 802.11 or a Zigbee IEEE 802.15 mesh or networking system may be used. As is apparent, any system that can enable the transference of signals to and from the transceivers 30 may be used. As such, in rescue environments that do not have a compatible network, the transceivers 30 may communicate using a proprietary or industry standard wireless means.

The signal fusion console 40 receives the communications from the transceivers 30 and processes the communication signals or information conveyed therein to provide location heuristics. The signal fusion console 40 may include a display 44 and an interface such as a keyboard, touchscreen, or communication port for control by an external human interface device (not shown). The exemplary signal fusion console 40 may also include an external communication interface 45 for communication to an external system/database 50. The external communication interface 45 may be any one or more of a modem, RF, LAN, IP, etc. system or network, as desired. In various exemplary embodiments, the external system/database 50 may operate as a data storage or retrieval system, providing building layouts, by information, calibration specifications etc. Accordingly, the external system 50 may operate as a controlling device and/or communication gateway to other fusion control consoles 40.

The signal fusion console 40 preferably, but not necessarily, should be placed at a convenient location within the rescue environment, such as, for example, at the entrance(s) of the rescue environment. For multiple entrance points within a rescue environment, a plurality of signal fusion consoles 40 may be distributed therein. Communication between the plurality of signal fusion console 40 may be effected by the external communication interface 45, which may enable a master-slave relationship between various signal fusion consoles 40. By situating the signal fusion console 40 at an entrance to the rescue environment, detection or registration of rescuers with their respective active/passive RFID devices 20 can be "logged" into the exemplary system. As rescuers navigate through the rescue environment, the transceivers 30 disposed at strategic locations within the rescue environment and in communication with the signal fusion console(s) 40, will operate to provide real-time location information regarding the rescuers.

Logging or the tracking of the RFID devices 20 can also be initiated "after" insertion into the rescue environment. For example, a rescue team may have additional ready-to-use RFID devices 20 in the event a device 20 fails during the rescue operation. Therefore, substitute RFID devices 20 may be used, being either pre-logged into the signal fusion console 40 or logged upon use. Additionally, RFID devices 20 may also be assigned to rescued personnel as they are found in the rescue environment. Therefore, as various RFID devices 20 are put "on-line" they may be logged into the system via the transceivers.

For enhanced coverage, the exemplary embodiment would distribute the transceivers 30 at strategic ingress and egress points within the facility/rescue environment, such as, for example, staircase entrances at floors or hallway sections, etc. For locations that are not within a transceiver 30 range, by correlating the last received signal from the transceiver 30, the signal fusion console(s) 40 can arrive at the location of a specific rescuer and the area of last presence.

The signal fusion console 40 can provide automatic registration and association of the rescuer's active/passive RFID information upon entry into a rescue environment or facility. This can be accomplished by rescuers "logging" into the system manually, or the signal fusion console 40 having a transceiver 30 to act as an automatic registration step. Upon registration, the signal fusion console 40 would store the rescue's information into its own database or to an external system/database 50, and relate the unique ID's from the active/passive units from the rescuers. The "main" controller in a plurality of signal fusion console(s) 40, preferably, by not necessarily, would contain an external telephone or communication interface to provide communication to an emergency service control center, the fire marshal, rescue headquarter, etc. The exemplary system 10 may operate in a stand alone configuration, being independent of any pre-existing tracking system within the rescue environment, or can be integrated into the pre-existing system or fire-alarm system, or access/security control system, as deemed appropriate.

Figure 2:
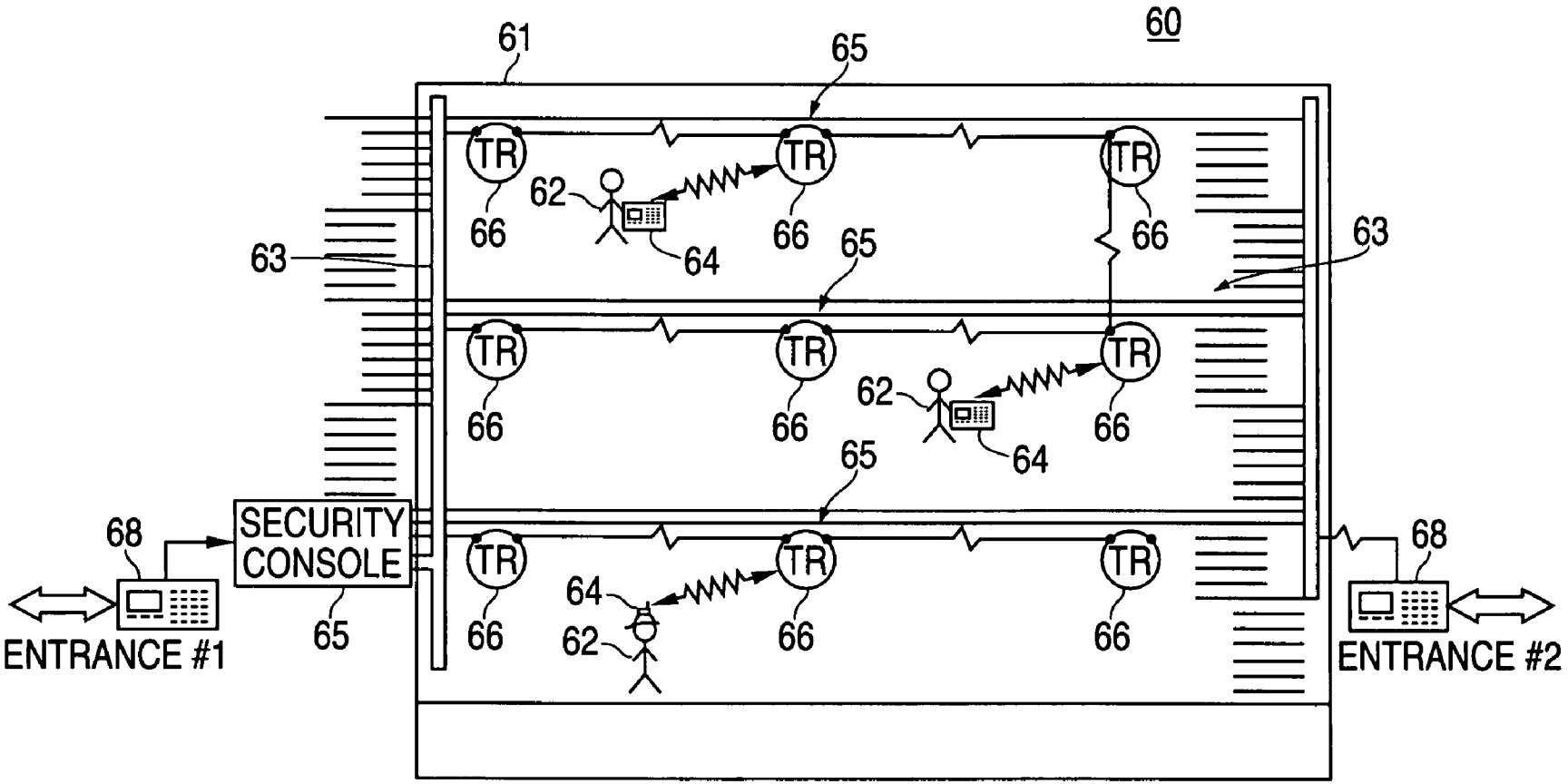
FIG. 2 is an illustration of an exemplary implementation.

FIG. 2 is a diagram illustrating an exemplary implementation 60 of the invention within a rescue environment. The rescue environment shown in FIG. 2 is a multi-floor building 61 having rescuers 62 dispersed therein with associated active/passive RFID devices 64. Each of the active/passive RFID devices 64 are in communication with various transceivers 66 distributed within the building 61. Transceiver 66 are distributed at various locations in the building 61 such as adjacent to stairwells 63 and near-center locations 65 within the floors. Each of the transceivers 66 are in communication with each other to enable "hopping" of signals between transceivers 66 or direct "addressing" to a fusion control console 68. Communication to the fusion control console 68 may be facilitated by wireless communications from the transceiver 66 or through a link to the building 61 security console 65. Based on the compatibility and capabilities of the building 61 security system, the exemplary embodiment shown in FIG. 2 may interface and exploit the network capabilities already resident in the building 61. Accordingly, resident personnel having compatible RFID devices 64 within the building 61, whether rescue personnel or workers in the building (e.g., security, maintenance, etc.), may automatically become integrated into the exemplary system 60 during an emergency. As such, data concerning the locations of tracked personnel may be transferred from the resident security system to the activated exemplary system 60, to assess whether certain personnel safely evacuated the building prior to arrival of the rescue team.

Figure 3:
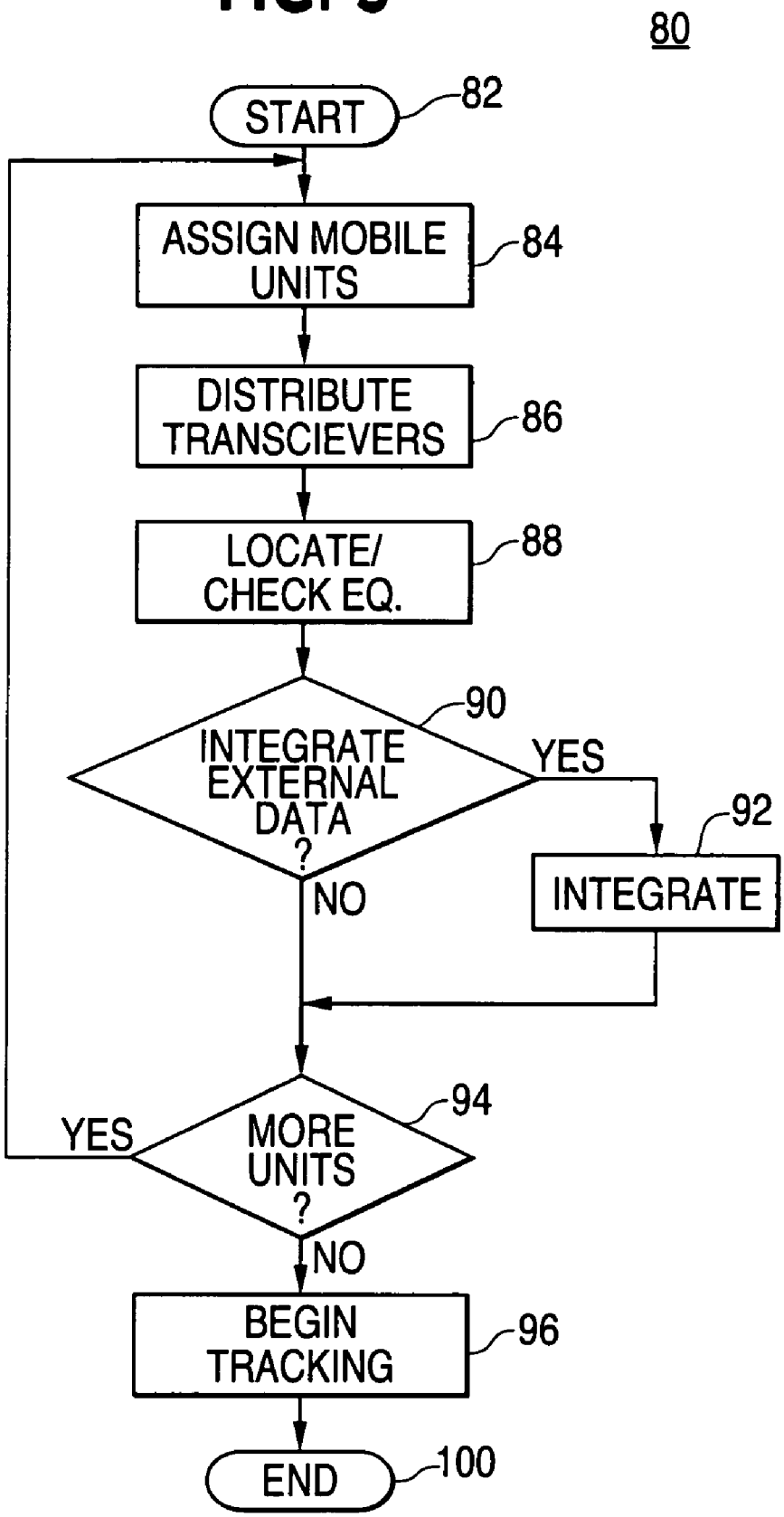
FIG. 3 is a flow chart of an exemplary process.

FIG. 3 is a flow chart illustrating an exemplary process 80 according to the invention. At step S82, the exemplary process 80 begins at step S82 and proceeds to step S84 where mobile RFID devices are assigned to rescuers. Step S84 may include initialization and rescuer identity registration with a signal fusion console or database for use by the signal fusion console. For example, the active RFID devices would generally be loaded or programmed in the manufacturing process with a descriptor, such as Fire Company A. The associated ID of a passive RFID device can also be programmed into the active RFID device's memory for a tighter linkage than the automatic assignment given during registration or entry, if so desired. Upon appropriate distribution and configuration of the mobile RFID devices, the exemplary process 80 proceeds to S86. Step S86 involves the distribution of transceivers within or about the emergency rescue environment. Appropriate distribution of the exemplary fusion control console 40 may also be initiated in step S86, if not already performed in step S84. The exemplary process 80 proceeds from step S86 to step S88, wherein an initial check of equipment is performed to ensure operability. Step S88 may include signal strength, testing, registration confirmation, assignment of transceivers to respective rescue teams, initial location testing, and other aspects of a rescue operation, as deemed needed. Various portions of Step S88 may also be performed in Step S86. For example, transceiver installations can be checked out by a transceiver initiating a signal for registration into the signal fusion console(s). A mobile RFID unit thereafter may be mobilized within the coverage area to evaluate and confirm proper coverage by the transceiver(s).

Upon appropriate completion of step S88, the exemplary process 80 proceeds to step S90, wherein external information such as a rescue environment layout is uploaded or coordinated with the transceivers and signal fusion console. Step S90 may include coordination with resident networking systems if available, and/or security/location system, and/or external system/databases, as deemed appropriate. If step S90 is applicable, the appropriate systems discussed above, as well as any other systems which may expedite a successful rescue mission, may be integrated in step S92, which in turn proceeds to step S94. If, however, step S90 is not applicable, the exemplary process 80 proceeds to step S94 to ascertain whether more RFID devices are necessary or if more transceivers are necessary. Based on information obtained from step S88, the exemplary process 80 may proceed immediately to step S94. For example, if step S88 results in the detection of faulty or incorrect equipment operation, step S94 is initiated. If more units are necesitated, the exemplary process 80 loops back to step S84 and proceeds to steps S86, S88, and S90, as needed. Upon the successful navigation of step S94, the exemplary process 80 proceeds to step S96 to begin tracking of the emergency rescuers. From step S96, the exemplary process proceeds until the tracking process is terminated at step S100.

It should be appreciated that one of ordinary skill, upon understanding the invention described herein, may incorporate various changes in the exemplary systems and process (es) described above without departing from the spirit and scope of the invention. For example, various portions of the steps outlined above may be performed in other steps, according to design preference, as well as various steps may be combined to form a single step. Additionally, in various exemplary embodiments, the transceiver(s) may be programmed individually from a remote system, either at the manufacturing plant or prior to incorporation into the exemplary system. Additional flexibility to the process(es) and system may also be incorporated by allowing several manual functions to be implemented in the configuration, such as, for example, identity binding with respect to teams and/or individuals, expedited registration, sanity checking, etc. With respect to sanity checking, when the transceiver(s) are distributed, a basic configuration test and verification process can be independently run, with the transceiver(s) providing a periodic signal or "heartbeat" indication to the signal fusion console. Upon registration and insertion into the rescue environment, tracking and status information can be conveyed between systems. In addition to tracking and status information, messaging may be sent between transceivers and/or RFID units and/or signal fusion consoles, such as, for example, emergency signals indicating "a man down" alert, "trapped," etc. Such messages may be preconfigured or dynamically created via pre-programmed controls or menus within the various portions of the exemplary system. With the exchange of such information, a database containing the locations and status of each individual/team can be continuously updated to reflect real-time tracking and status alerting.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An emergency personnel tracking system, comprising:

a personal, mobile short range, passive RFID device;

a personal, mobile long range, active RFID device;

a fixed location transceiver, capable of initiating a communication from the passive RFID device, located within a rescue environment; and a signal fusion console receiving communications from the transceiver, wherein the passive and active RFID devices are in communication with the transceiver to provide an information of the passive and active RFID devices, and the transceiver is in communication with the signal fusion console, wherein the signal fusion console relays a location information of the passive and active RFID devices for tracking of emergency personnel about the rescue environment, wherein the signal fusion console performs a check of the passive and active RFID devices and transceivers prior to distributing the transceivers, and wherein the check comprises determining a signal strength of the passive and active RFID devices and the transceivers, testing the passive and active RFID devices and the transceivers to determine whether functioning properly, and initial location testing.

2. The system of claim 1, wherein the passive RFID device is at least one or more of a device from a group consisting of a badge, mobile phone, Personal Digital Assistant (PDA), and communication-equipped helmet.

3. The system of claim 1, wherein the transceiver is in communication with the signal fusion console via a wireless link.

4. The system of claim 3, wherein there are a plurality of transceivers in communication with the signal fusion console.

5. The system of claim 4, wherein the plurality of transceivers are in communication with each other.

6. The system of claim 1, wherein the transceiver is in communication with the signal fusion console via a wired network.

7. The system of claim 1, wherein there are a plurality of signal fusion consoles.

8. The system of claim 7, wherein the plurality of signal fusion consoles are controlled in a master-slave configuration.

9. The system of claim 1, wherein the signal fusion console is coupled to an external database.

10. The system of claim 1, wherein the signal fusion console contains a status indicator, a user interface, and an external communication link.

11. The system of claim 1, wherein active RFID device is configured with an ID of the passive RFID device.

12. The system of claim 1, wherein the emergency personnel are rescued personnel.

13. A method for tracking emergency personnel in a rescue environment, comprising the steps of:

configuring personal, mobile passive RFID devices for emergency rescue operation;

configuring personal, mobile active RFID devices for emergency rescue operation;

configuring transceivers for communication with the passive and active RFID devices;

distributing at least one of the configured transceivers within the rescue environment;

tracking the passive and active RFID devices within the rescue environment via communications received from the at least one of the configured transceivers to a signal fusion console; and performing a check of the passive and active RFID devices and transceivers prior to distributing the transceivers, wherein the check comprises determining a signal strength of the passive and active RFID devices and the transceivers, testing the passive and active RFID devices and the transceivers to determine whether functioning properly, and initial location testing.

14. The method according to claim 13, wherein the step of performing comprises registration confirmation.

15. The method according to claim 13, further comprising the step of:

integrating layout information of the rescue environment into the signal fusion console.

16. The method according to claim 13, wherein the steps of configuring the RFID devices includes assigning an individual rescue personnel identifier to the RFID device.

17. The method according to claim 13, further comprising the step of:

locating the fusion control console at least one of an egress or ingress of the rescue environment.

18. The method according to claim 13, further comprising the step of:

initiating an alarm signal via the RFID device to the fusion console.

19. The method according to claim 13, further comprising the step of:

communicating information to an external center from the fusion control console, in response to a condition indicated by the fusion control console.

20. The method according to claim 13, further comprising assigning a rescued person an RFID device.

21. The method according to claim 13, further comprising assigning the transceivers to respective rescue teams.

* * * * *